US008850975B2

(12) United States Patent
Zlatin et al.

(10) Patent No.: US 8,850,975 B2
(45) Date of Patent: Oct. 7, 2014

(54) IMPRESSION MECHANISM FOR A VARIABLE CUTOFF PRINTING UNIT

(75) Inventors: Lev Zlatin, Portsmouth, NH (US); Andrew Work Kelsall, Dover, NH (US); Mark Bernard Dumais, Kennebunk, ME (US)

(73) Assignee: Goss International Americas, Inc., Durham, NH (US)

( * ) Notice: Subject to any disclaimer, the term of this patent is extended or adjusted under 35 U.S.C. 154(b) by 579 days.

(21) Appl. No.: 12/836,713

(22) Filed: Jul. 15, 2010

(65) Prior Publication Data

US 2012/0012017 A1 Jan. 19, 2012

(51) Int. Cl.
*B41F 13/44* (2006.01)
*B41F 13/32* (2006.01)

(52) U.S. Cl.
CPC ..... *B41F 13/44* (2013.01); *B41F 13/32* (2013.01)
USPC ..... 101/218; 101/247

(58) Field of Classification Search
CPC ..... B41F 13/44; B41F 13/32; B41F 13/36; B41F 13/40
USPC ..... 101/182, 184, 185, 216, 218, 247, 249
IPC ..... B41F 13/008, 13/44, 7/02
See application file for complete search history.

(56) References Cited

U.S. PATENT DOCUMENTS

| | | | | |
|---|---|---|---|---|
| 3,616,751 | A | 11/1971 | Mowry | |
| 5,813,336 | A | 9/1998 | Guaraldi et al. | |
| 6,694,877 | B1 | 2/2004 | Wolters et al. | |
| 7,089,858 | B2 * | 8/2006 | Iwamoto | 101/479 |
| 2005/0160928 | A1 | 7/2005 | Motard et al. | |
| 2006/0219115 | A1 | 10/2006 | Gentle et al. | |
| 2007/0157832 | A1 | 7/2007 | Menu et al. | |

FOREIGN PATENT DOCUMENTS

| | | |
|---|---|---|
| EP | 1 101 611 A | 5/2001 |

* cited by examiner

*Primary Examiner* — Judy Nguyen
*Assistant Examiner* — Jennifer Simmons
(74) *Attorney, Agent, or Firm* — Davidson, Davidson & Kappel, LLC

(57) ABSTRACT

A variable cutoff printing unit is provided that includes a plate cylinder, a plate cylinder support removably supporting the plate cylinder, a blanket cylinder, a blanket cylinder support removably supporting the blanket cylinder, a frame, the plate cylinder support and the blanket cylinder support being coupled to the frame, a sliding element coupled to the blanket cylinder support for moving the blanket cylinder support toward and away from the plate cylinder support, and a stopping device for stopping movement of the sliding element to limit the movement of the blanket cylinder toward and away from the plate cylinder to a defined range. A method of operating a variable cutoff printing unit is also provided.

27 Claims, 7 Drawing Sheets

IMPRESSION MECHANISM FOR A VARIABLE CUTOFF PRINTING UNIT

The present invention relates generally to printing units and more specifically to printing units of variable cutoff web offset printing presses.

BACKGROUND OF INVENTION

U.S. Pat. No. 5,813,336, which is hereby incorporated by reference herein, discloses a printing unit with a rotatable print cylinder and a rotatable blanket cylinder. A tubular printing blanket is removably mounted on the blanket cylinder. The printing unit may have an imaging unit mounted therein. A printing member, which is mountable on the print cylinder, is imaged by the imaging unit inside the printing unit. The printing member has a continuous surface and may be removed axially from the print cylinder. The printing unit may be configured as a cantilever printing unit, or, alternatively, may be configured with both a gear side frame and a work side frame for supporting the print and blanket cylinders. In order to provide a variable-cutoff capability, a plurality of print cylinder saddles may be provided. Each print cylinder saddle has the same inner diameter for mounting on the print cylinders. However, in order to provide a variable cut-off, the print cylinder saddles may have a variety of outer diameters.

U.S. Pat. No. 6,694,877 discloses a printing assembly including an image printing cylinder, a transfer printing cylinder and an impression printing cylinder. The image printing cylinder is supported in a fixed position with respect to a U-shaped supporting construction, the transfer printing cylinder is supported on both ends between two supporting elements and the impression printing cylinder is supported on both ends between two supporting elements. The supporting elements are connected to respective bearing arms that are rotatable about a single axis. The bearing aims of the transfer printing cylinder are each rotated by respective first actuating means and the bearing arms of the impression printing cylinder are each rotated by respective second actuating means. The second actuating means are connected to the bearing arms of the transfer printing cylinder, causing the second actuating means to move along with a rotation of the bearing arm of the transfer printing cylinder if the first actuating means are actuated.

BRIEF SUMMARY OF THE INVENTION

A variable cutoff printing unit is provided that includes a plate cylinder, a plate cylinder support removably supporting the plate cylinder, a blanket cylinder; a blanket cylinder support removably supporting the blanket cylinder, a sliding element coupled to the blanket cylinder support for moving the blanket cylinder support toward and away from the plate cylinder support, and a stopping device for stopping movement of the sliding element to limit the movement of the blanket cylinder toward and away from the plate cylinder to a defined range.

Also, a variable cutoff printing unit is provided that includes a blanket cylinder, an additional cylinder, a blanket cylinder support removably supporting the blanket cylinder, the blanket cylinder support including a first face and a second face that define a slot in the blanket cylinder support, an additional cylinder support removably supporting the additional cylinder, the additional cylinder support adapted for lifting the blanket cylinder support, an arm extending into the slot, the arm being movable between contact with the first face and contact with the second face by the impression cylinder support lifting the blanket cylinder support.

A method of operating a variable cutoff printing unit including a blanket cylinder support having a slot formed therein, an additional cylinder support, an arm extending into the slot, a sliding element coupled to the arm and a stopping device is also provided. The method includes setting a position of the blanket cylinder support by contacting the stopping device with the sliding element as the arm contacts a first face of the slot formed in the blanket cylinder support; and contacting the blanket cylinder support with the additional cylinder support so that the arm moves away from the first face of the slot.

BRIEF DESCRIPTION OF THE DRAWINGS

The present invention is described below by reference to the following drawings, in which.

DETAILED DESCRIPTION

A variable cutoff printing unit as used herein refers to a printing unit that can be modified between print jobs so that the printing unit can print repeating images of different lengths during different print jobs. The length of the repeating images printing during a particular print job is commonly referred to as a cutoff length or a cutoff. Plate cylinders and blanket cylinders that print the repeating images for the particular print job (and the plates and blanket mounted on the cylinders) may be said to have that cutoff length or cutoff. For example, a variable cutoff printing unit can print repeating images of a first cutoff length on a web or other substrate during a first print job and then can print repeating images of a second cutoff length that varies from the first cutoff length on a web or other substrate during a subsequent second print job. The first print job is printed using a first printing plate and a first printing blanket each having an outer circumference of a length corresponding to the first cutoff length. After the first print job and before the second print job, the first printing plate and the first printing blanket are removed from the printing unit and replaced with a second printing plate and a second printing blanket that each have outer circumferences of a length corresponding to the second cutoff length. A change between print jobs that involves replacing printing plates and blankets having a first cutoff length with printing plates and blankets having a second cutoff length may be referred to as a cutoff change.

Figure 1:
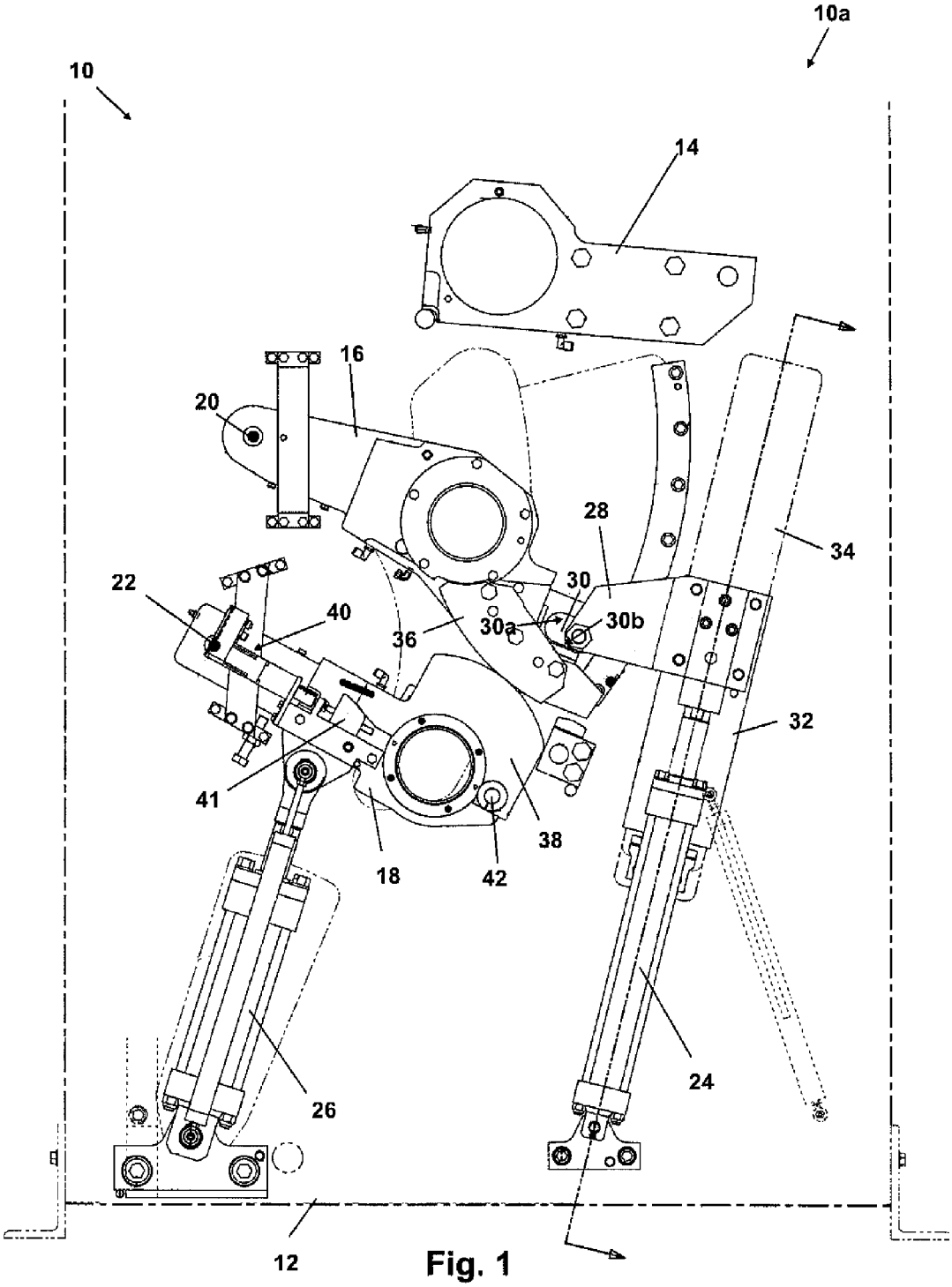
FIG. 1 shows a side view of an inside portion of a gear side of a support apparatus for removably supporting different sized plate cylinders, blanket cylinders and impression cylinders of a variable cutoff printing unit.

FIG. 1 shows a side view of a support apparatus 10 for removably supporting plate cylinders, blanket cylinders and impression cylinders in a variable cutoff printing unit. Support apparatus 10 has a gear side 10*a* and a work side 10*b* (FIG. 2) and includes a frame 12. FIG. 1 shows an inside portion of gear side 10*a* of support apparatus 10 (i.e., the portion of gear side 10*a* that faces work side 10*b* (FIGS. 2 to 4)). Gear side 10*a* of support apparatus 10 includes a plate cylinder support 14, a blanket cylinder support 16 and an impression cylinder support 18 coupled to frame 12. Cylinder supports 14, 16, 18 are adapted to support a first axial end of plate cylinders, blanket cylinders and impression cylinders, respectively. In this embodiment, plate cylinder support 14 is non-rotatably fixed to frame 12 so that plate cylinder support 14 is not movable toward blanket cylinder support 16 to adjust a radial position of a plate cylinder supported by plate cylinder support 14. Blanket cylinder support 16 and impression cylinder support 18 are rotatably coupled to frame 12 at respective pivot points 20, 22 so blanket cylinder support 16 and impression cylinder support 18 may be rotated about respective pivot points 20, 22 by respective actuators 24, 26 to allow support apparatus 10 to accommodate plate and blanket cylinders having varying cutoff lengths (i.e., outer circumferences).

On gear side 10*a*, support apparatus 10 includes an arm 28, a sliding element 32 and blanket cylinder support actuator 24 for moving blanket cylinder support 16. Arm 28 is connected to sliding element 32 and can couple sliding element 32 to blanket cylinder support 16 so actuator 24 can lift blanket cylinder support 16. Sliding element 32 slides in a frame slot 34 formed in frame 12 that extends vertically within frame 12. As shown in FIG. 1, slot 34 may be angled with respect to a bottom of frame 12 so slot 34 extends both horizontally and vertically within frame 12. Actuator 24 adjusts the vertical position of blanket cylinder support 16 by moving sliding element 32 in slot 34. Actuator 24 moves sliding element along frame 12 to move blanket cylinder support 16 toward and away from plate cylinder support 14. Arm 28 includes a roller cam, which may be the same as roller cam 100 shown in FIG. 2, that extends into a blanket cylinder support slot 30 formed in blanket cylinder support 16.

Slot 30 is vertically wider than a portion of the roller cam within slot 30 so that the roller cam may be moved from a first position where the roller cam contacts an upper face 30*a* of slot 30 to a second position where the roller cam contacts a lower face 30*b* of slot 30. When the position of arm 28 is fixed and impression cylinder support 18 does not support blanket cylinder support 16, arm 28 supports blanket cylinder support 16 and upper face 30*a* rest on the roller cam of arm 28. When impression cylinder support 18 is forced upward by the impression cylinder support actuator 26 so that impression cylinder support 18 lifts blanket cylinder support 16 upward, the roller cam of arm 28 is moved out of contact with upper face 30*a* and into contact with lower face 30*b*. In this position, which corresponds to the printing position for the cylinders supported by supports 14, 16, 18, arm 28 prevents blanket cylinder support 16 and impression cylinder support 18 from being moved further upward by contacting lower face 30*b*.

Blanket cylinder support 16 and impression cylinder support 18 each include respective cams 36, 38 that contact one another so actuator 26 can lift blanket cylinder support 16 via impression cylinder support 18 into printing position. Impression cylinder support 18 includes a cam actuator 40 coupled to impression cam 38 for moving a wedge 41 on impression cylinder support towards and away from pivot point 22. Movement of wedge 41 by cam actuator 40 toward and away from pivot point 22 causes an angled top surface of wedge 41 to slide against an angled bottom surface of impression cam 38 so impression cam 38 rotates about a pivot 42 to move impression cam 38 toward and away from blanket cam 36. As a result, cam actuator 40 may adjust a distance between centers of cylinders supported by supports 16, 18 to properly position the cylinders for printing based on a desired nip pressure and the thickness of a web to be printed. In other embodiments, only blanket cam 36 may include a cam actuator or both blanket cam 36 and impression cam 38 may include cam actuators. In a preferred embodiment, cams 36, 38 are shaped to have curvatures such that, without adjusting cam 38 with cam actuator 40, movement of impression cylinder support 16 by actuator 26 automatically gives the preferred distance between a center of the blanket cylinder supported by blanket cylinder support 16 and a center of the impression cylinder supported by impression cylinder 18.

Actuator 26 may pivot impression cylinder support 18 about pivot point 22 downwardly to move impression cylinder support 18 to an off impression position. As shown in FIGS. 3*a* to 4, an adjustable stopping device 90 may be provided on gear side 10*a* of frame 12 on an outside portion of gear side 10*a* (i.e., the portion of gear side 10*a* that faces away from work side 10*b* (FIGS. 2 to 4)) to limit the vertical movement of cylinder supports 16, 18. A stop 44 (FIGS. 3*a* to 4) of adjustable stopping device 90 may be provided on sliding element 32 so stop 44 is coupled to arm 28 via sliding element 32. Sliding element 32 may be moved by actuator 24 so stop 44 (FIGS. 3*a* to 4) is positioned against an adjustable block 47 (FIGS. 3*a* to 4) at the top of a stop guide slot 45 (FIGS. 3*a* to 4) formed in adjustable block 47. When stop 44 (FIGS. 3*a* to 4) is positioned against adjustable block 47 (FIGS. 3*a* to 4) in this manner, actuator 26 may move impression cylinder support 18 back into an on impression position by moving impression cylinder support 18 upward so that impression cam 38 contacts blanket cam 36 and impression cylinder support 18 lifts blanket cylinder support 16 upward until lower face 30*b* of slot 30 contacts the roller cam of arm 28. Adjustable block 47 (FIGS. 3*a* to 4) thus sets an appropriate center distance between the plate and blanket cylinders for a desired cutoff by fixing the position of arm 28 and limiting the movement of blanket cylinder support 16 to a defined range. Center distances between cylinders held by plate cylinder support 14 and blanket cylinder support 16 may be set by setting the position of adjustable block 47 (FIGS. 3*a* to 4) and lifting blanket cylinder support 16 via impression cylinder support 18 so lower face 30*b* contacts the roller cam of arm 28.

Figure 2:
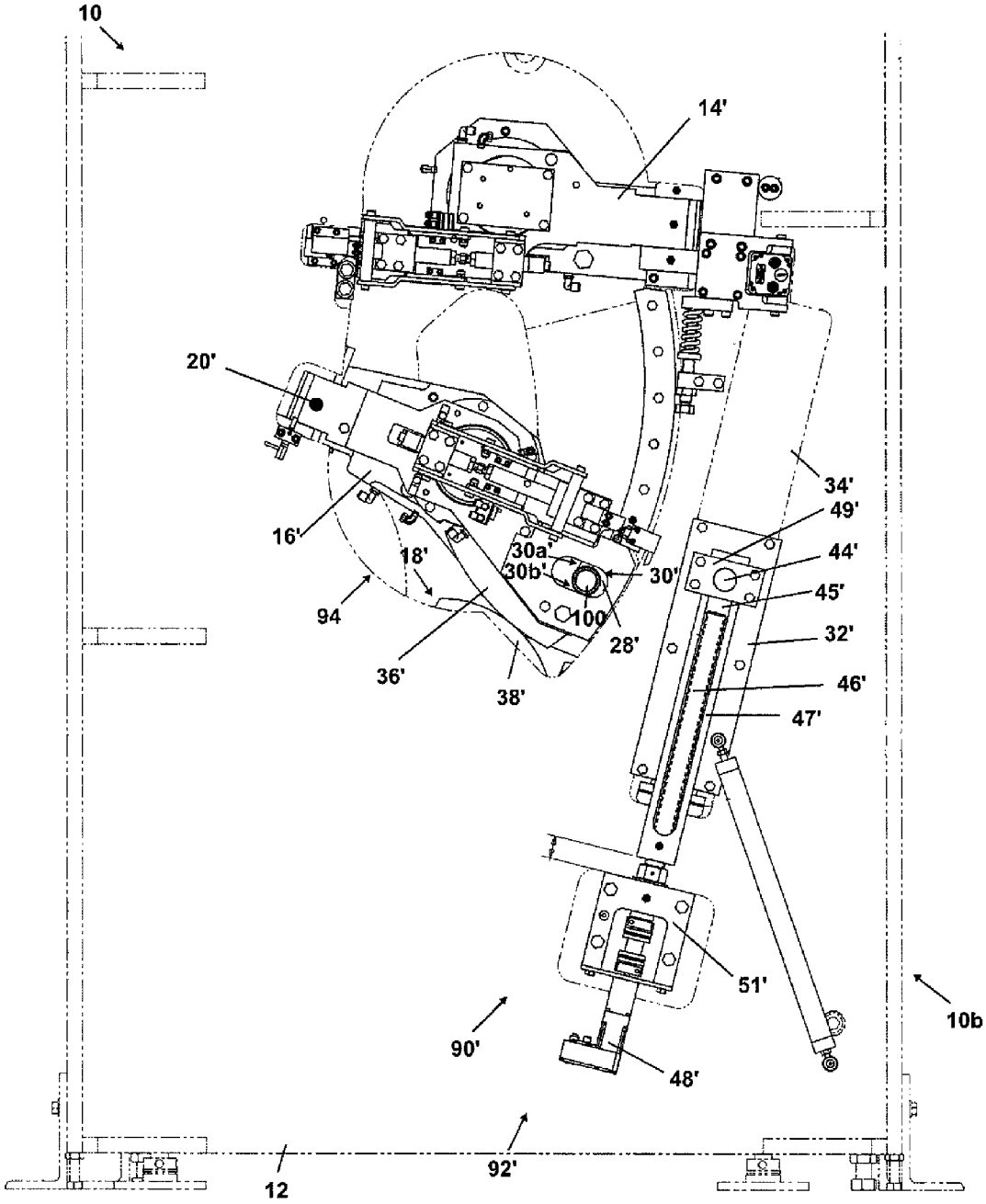
FIG. 2 shows a side view of an outside portion of a work side the support apparatus shown in FIG. 1.
Figure 3A:
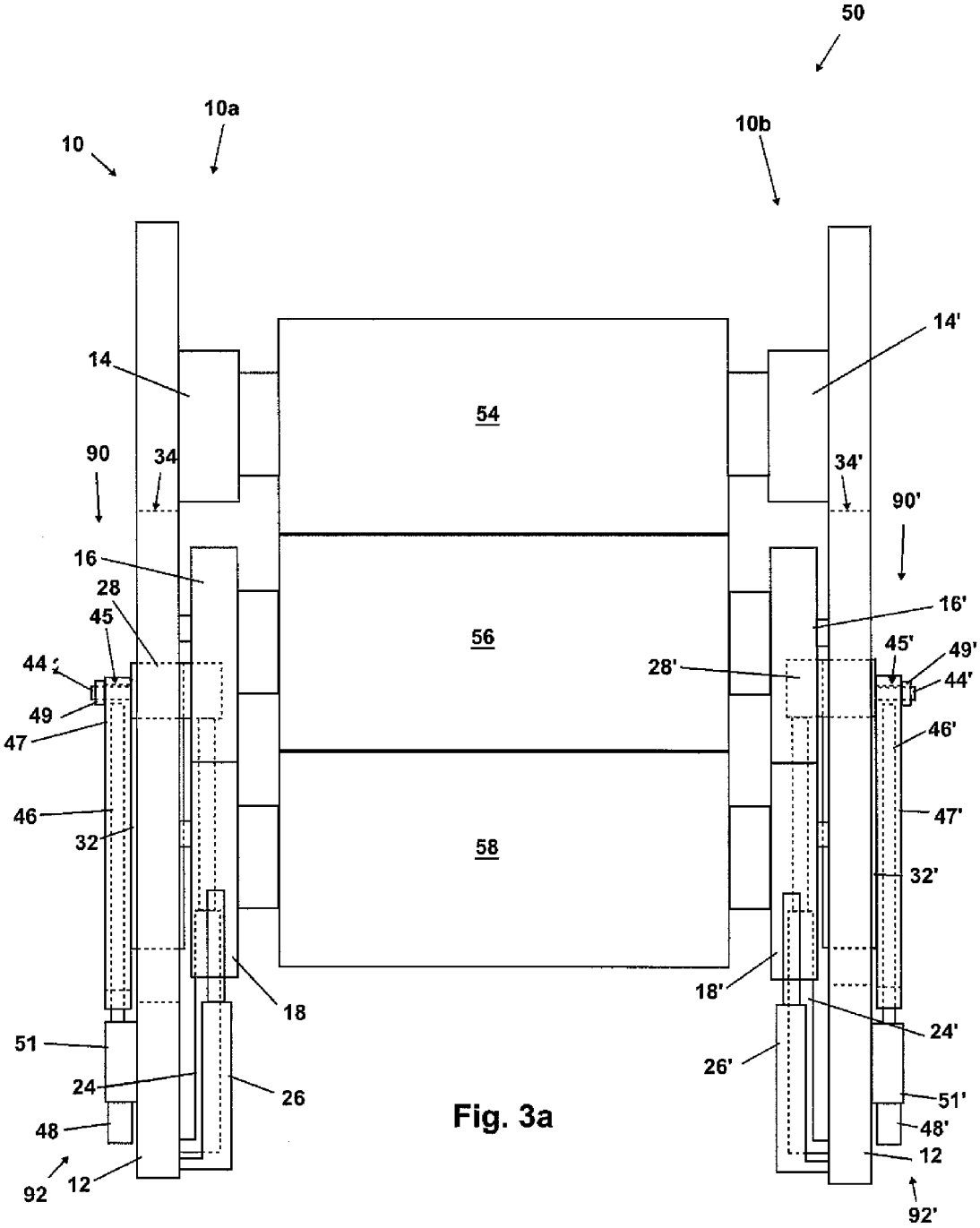
FIG. 3*a* schematically shows a front view of a variable cutoff web offset printing unit including the support apparatus shown in FIGS. 1 and 2.

FIG. 2 shows a side view of an outside portion of work side 10*b* of support apparatus 10 (i.e., the portion of work side 10*b* facing away from gear side 10*a* (FIGS. 1 and 3*a* to 4)). Work side 10*b* of support apparatus 10 includes a plate cylinder support 14', a blanket cylinder support 16' and an impression cylinder support 18' (FIGS. 3*a* to 4) coupled to frame 12. Cylinder supports 14', 16', 18' are adapted to support a second axial end of plate cylinders, blanket cylinders and impression cylinders, respectively. In this embodiment, plate cylinder support 14' is non-rotatably fixed to frame 12 so that plate cylinder support 14' is not movable toward blanket cylinder support 16' to adjust a radial position of a plate cylinder supported by plate cylinder support 14'. Blanket cylinder support 16' is rotatably coupled to frame 12 at a pivot point 20' so blanket cylinder support 16' may be rotated about pivot point 20' by a blanket actuator 24 during a cutoff change. Also, impression cylinder support 18' is rotatably coupled to frame 12 at a pivot point so impression cylinder support 16' may be rotated about the pivot point by an impression actuator 26 during a cutoff change.

On work side 10*b*, support apparatus 10 includes an arm 28', a sliding element 32' and blanket cylinder support actuator 24' for moving blanket cylinder support 16'. Arm 28' is connected to sliding element 32' and can couple sliding element 32' to blanket cylinder support 16' so actuator 24' can lift blanket cylinder support 16'. Sliding element 32' slides in a frame slot 34' formed in frame 12' that extends vertically within frame 12'. As shown in FIG. 2, slot 34' may be angled with respect to a bottom of frame 12 so slot 34' extends both horizontally and vertically within frame 12. Actuator 24' adjusts the vertical position of blanket cylinder support 16' by moving sliding element 32' in slot 34'. Actuator 24' moves sliding element along frame 12' to move blanket cylinder support 16' toward and away from plate cylinder support 14'. Arm 28' includes a roller cam 100 that extends into a blanket cylinder support slot 30' formed in blanket cylinder support 16'. On a side of sliding element 32' opposite of arm 28', a stop 44' is coupled to sliding element 32.

Blanket cylinder support 16' and impression cylinder support 18' each include respective cams 36', 38' that may be configured and operate in the same manner as cams 36, 38 (FIG. 1). Work side 10*b* includes an opening 94 formed in frame 12 that allows plate and blanket cylinder supports 14', 16', which may be hinged with respect to frame 12, to be swung away from gear side 10*a* (FIGS. 1 and 3*a* to 4) through frame 12 so that plate cylinder and blanket cylinders supported by plate cylinder support 14' and blanket cylinder support 16' can be removed and replaced.

Support apparatus 10 may include an adjustable stopping device 90' that may be used to set an appropriate center distance of cylinders supported by plate cylinder support 14' and blanket cylinder support 16'. In a preferred embodiment, adjustable stopping device 90' may be coupled to sliding element 32' on the opposite side of frame 12 as actuator 26' (FIG. 3*a*). Adjustable stopping device 90' acts to set a maximum vertical position of sliding element 32' that corresponds to a desired cutoff of a print job to be printed by the cylinders supported by plate cylinder support 14' and blanket cylinder support 16'. Adjustable stopping device 90' may include an adjustable block 47' that has a stop guide slot 45' formed therein and a guide 49' that guides adjustable block 47' along sliding element 32'. Stop 44' is positioned within stop guide slot 45' and contact between adjustable block 47' at the top of stop guide slot 45' prevents sliding element 32' and arm 28' from being moved upward. Adjustable stopping device 90' may also include an actuator 92' coupled to adjustable block 47' for adjusting a vertical position of adjustable block 47' with respect to frame 12 and frame slot 34'. Actuator 92' may include a threaded rod 46' passing through a threaded slot formed in the bottom of adjustable block 47' and a smart motor 48' for turning threaded rod 46' to move adjustable block 47' up and down along sliding element 32' and parallel to frame 12. Adjustable stopping device 90' may include a bracket 51' between smart motor 48' and threaded rod 46' for coupling adjustable stopping device 90' to frame 12.

Adjustable stopping device 90' sets a position of adjustable block 47' that prevents sliding element 32' from being moved further upward, but allows blanket cylinder support 16' to be moved closer to plate cylinder support 14' because roller cam 100 can move vertically within slot 30' between faces 30*a*', 30*b*'. Adjustable block 47' limits the vertical movement of sliding element 32' to set a printing position of a blanket cylinder supported by blanket cylinder support 16' by setting the position of roller cam 100 of arm 28'. In other words, adjustable stopping device 90' stops upward movement of arm 28' and limits the vertical movement of blanket cylinder support 16' toward the plate cylinder support 14' based on a range defined by a distance between faces 30*a*', 30*b*' and a size of roller arm 100. When sliding element 32' is moved upward so that stop 44' is moved into contact with the adjustable block 47' at the top of stop guide slot 45' and blanket cylinder support 16' is not lifted by impression cylinder support 18', upper face 30*a*' rests on roller cam 100. In this position, impression cylinder support 18' may then lift blanket cylinder support 16' until lower face 30*b*' of slot 30' contacts roller arm 100 so that the blanket cylinder supported by blanket cylinder support 16' is in a printing position (i.e., in contact with the impression cylinder supported by impression cylinder support 18' and the plate cylinder supported by plate cylinder support 14'). To change the cutoff accommodated by support apparatus 10, the vertical position of stop 44' is adjusted by actuator 92'. For example, to modify support apparatus 10 to accommodate cylinders that have a smaller cutoff length than support apparatus 10 is currently set to accommodate, smart motor 48' may rotate threaded rod 46' so adjustable block 47' slides upward in guide 49'. Then, sliding block 32' may move upward until stop 44' contacts adjustable block 47' at the top of stop guide slot 45'.

Figure 3B:
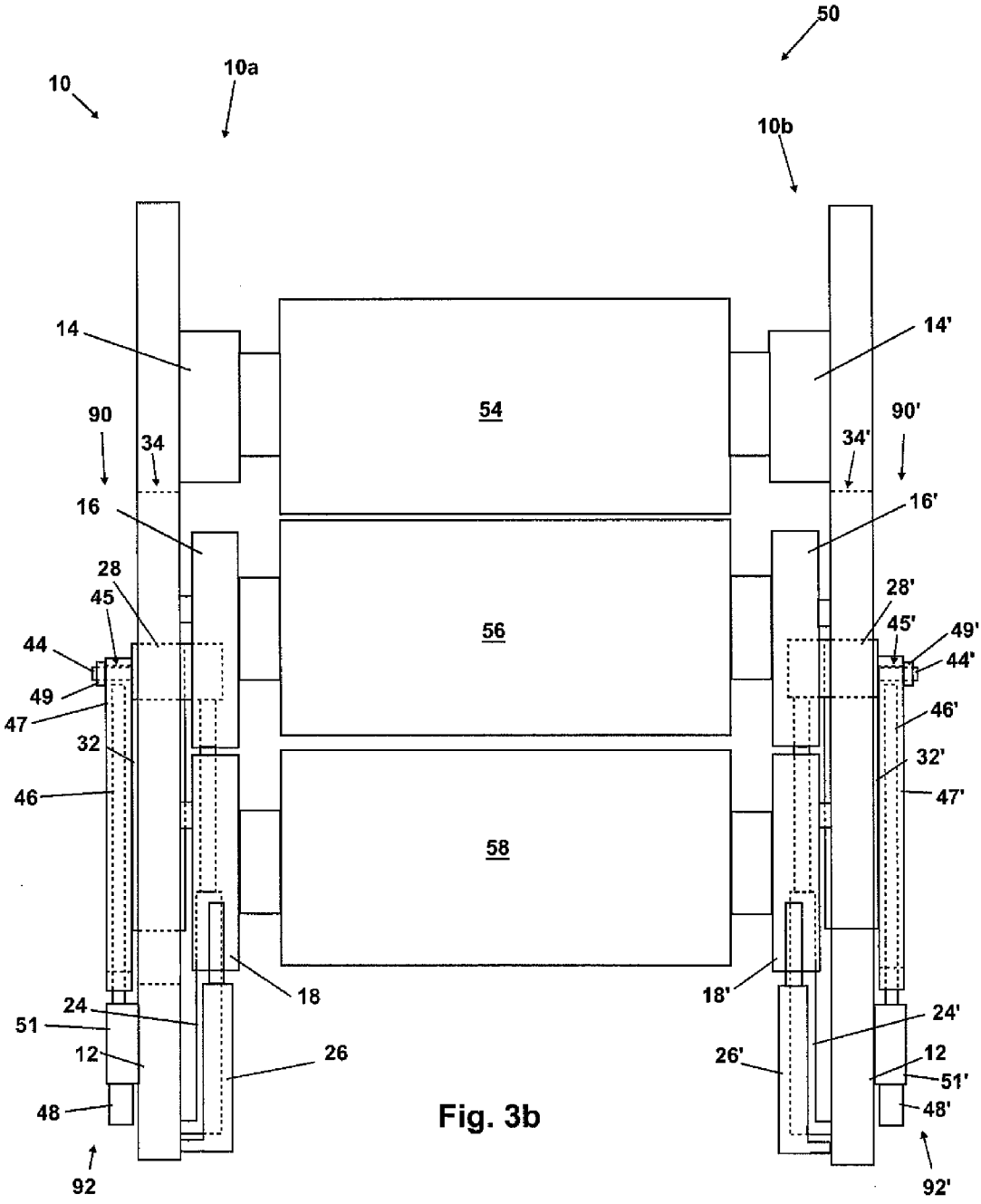
FIG. 3*b* schematically shows the printing unit shown in FIG. 3*a* with a blanket cylinder and an impression of the printing unit in off-impression positions.
Figure 3C:
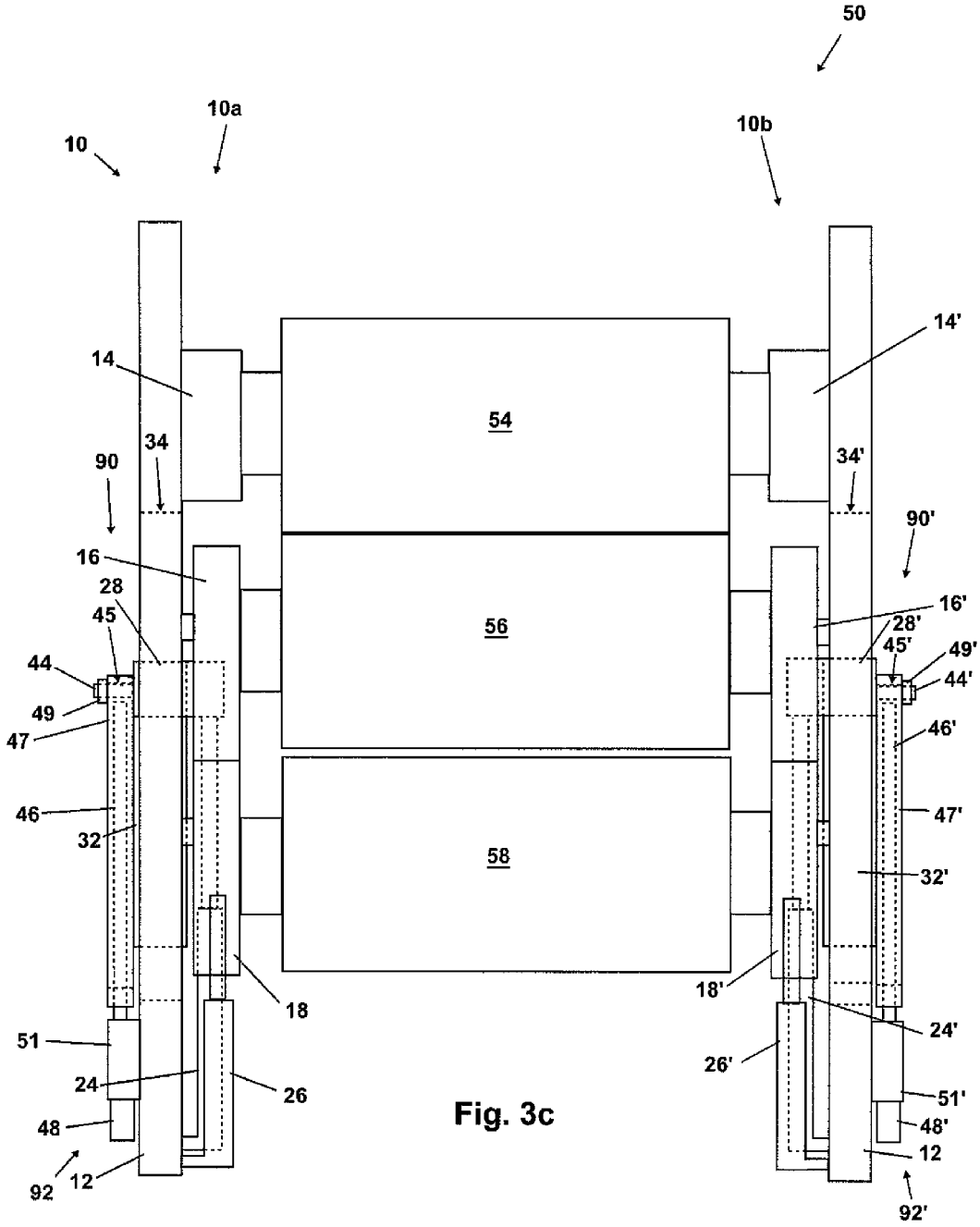
FIG. 3*c* schematically shows the printing unit shown in FIGS. 3*a* and 3*b* the blanket cylinder and the impression cylinder of the printing unit in autoplating positions.
Figure 4:
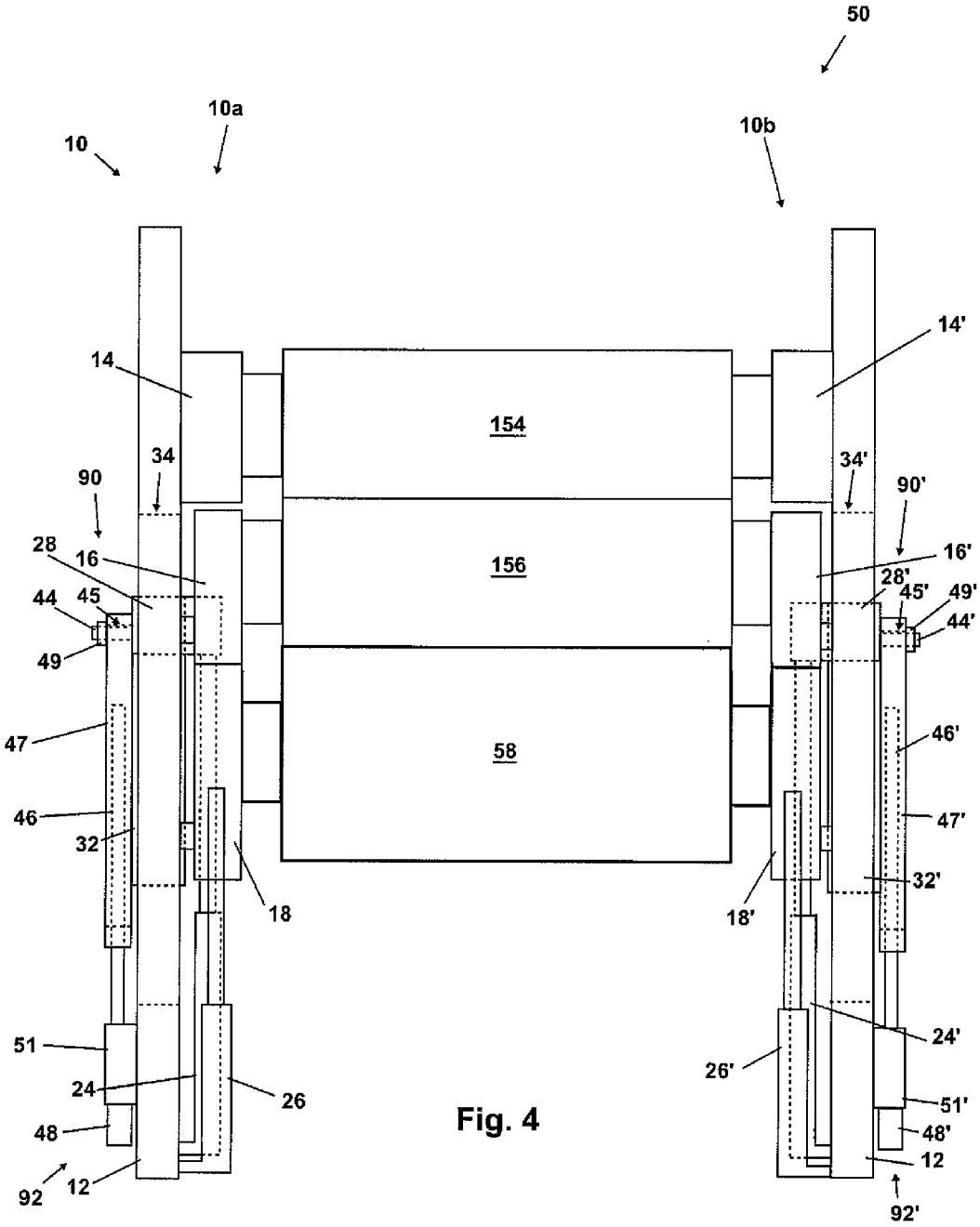
FIG. 4 schematically shows the printing unit shown in FIGS. 3*a* to 3*c* with the support apparatus removably supporting a plate cylinder and a blanket cylinder having a smaller cutoff length than a plate cylinder and the blanket cylinders shown in FIGS. 3*a* to 3*c*.

FIGS. 3*a* to 3*c* schematically show a front view of a variable cutoff printing unit 50 including support apparatus 10 shown in FIGS. 1 and 2. Certain parts of support apparatus 10 are omitted for clarity and simplicity. As discussed with respect to FIGS. 1 and 2, support apparatus 10 includes plate cylinder support 14, blanket cylinder support 16 and impression cylinder support 18 coupled to frame 12 on gear side 10*a* and plate cylinder support 14', blanket cylinder support 16' and impression cylinder support 18' on work side 10*b*. Variable cutoff printing unit 50 includes a first plate cylinder 54 rotatably supported by plate cylinder supports 14, 14', a first blanket cylinder 56 rotatably supported by blanket cylinder supports 16, 16' and an impression cylinder 58 rotatably supported by impression cylinder supports 18, 18'.

Adjustable stopping device 90 is constructed in substantially the same manner as adjustable stopping device 90' and is provided on gear side 10*a* for setting the center distances between plate cylinder 54 and blanket cylinder 56. Adjustable stopping device 90 also includes stop 44 connected to sliding element 32, adjustable block 47 that has a stop guide slot 45 formed therein, a guide 49 that guides adjustable block 47 along sliding element 32 and an actuator 92, which may include threaded rod 46 and smart motor 48, coupled to adjustable block 47 for adjusting a vertical position of adjustable block 47 with respect to frame slot 34. Adjustable stopping device 90 may also include a bracket 51 between smart motor 48 and threaded rod 46 for coupling adjustable stopping device 90 to frame 12. Thus, gear side 10*a* may be adjusted in substantially the same manner as work side 10*b* to support cylinders of varying cutoffs.

In FIG. 3*a*, cylinders 54, 56, 58 are shown on-impression in position to print a web passing between cylinders 56, 58. Actuator 24 has forced sliding block 32 upward, positioning stop 44 against stop guide slot 45. Also, actuator 26 has forced blanket cylinder support 16 upward via impression cylinder support 18 so upper face 30*a* (FIG. 1) is moved out of contact with the roller cam of arm 28 and lower face 30*b* (FIG. 1) is moved into contact with the roller cam of arm 28. Similarly, on work side 10*b*, stop 44' is positioned against the top of stop guide slot 45' by actuator 24' and actuator 26' has forced impression cylinder support 18' and blanket cylinder support 16' upward so upper face 30*a*' (FIG. 2) is moved from contact with roller cam 100 (FIG. 2) of arm 28' and lower face 30*b*' (FIG. 2) is moved into contact with the roller cam of arm 28'.

In FIG. 3*b*, printing unit 50 is shown with cylinders 54, 56, 58 in off-impression positions. Actuators 26, 26' have moved impression cylinder supports 18, 18' away from blanket cylinder supports 16, 16' and blanket cylinder supports 16, 16' have moved downward so that upper face 30*a* rests on the roller cam of arm 28 and upper face 30*a*' rests on roller cam 100 of arm 28' and blanket supports 16, 16' are supported by arms 28, 28'.

In FIG. 3*c*, printing unit 50 is shown with cylinders 54, 56, 58 in positions so that a new printing plate may be automatically placed onto plate cylinder 54 (i.e., autoplating). In this position, cam actuator 40 (FIG. 1) has slid wedge 41 (FIG. 1) away from pivot point 22 so impression cam 38 positions impression cylinder support 18 with respect to blanket cylinder support 16 to form a gap between impression cylinder 58 and blanket cylinder 56. Similarly, on impression cylinder support 18', a cam actuator has slid a wedge away from pivot point 22' (FIG. 2) so impression cam 38 positions impression cylinder support 18' with respect to blanket cylinder support 16' in the same manner as supports 16, 18. As a result, actuators 26, 26' may lift corresponding supports 16, 16', 18, 18' to force blanket cylinder 56 into contact with plate cylinder 54 for autoplating while maintaining the gap between impression cylinder 58 and blanket cylinder 56 for a web to pass through.

FIG. 4 schematically shows printing unit 50 with a second plate cylinder 154, a second blanket cylinder 156 and impression cylinder 58 supported by support apparatus 10. All elements of printing press 50 shown in FIG. 4 and not discussed below operate in the same manner as described with respect to FIGS. 1 to 3*c*. In comparison to FIGS. 3*a* to 3*c*, first cylinders 54, 56 have been removed from respective supports 14, 14', 16, 16' and replaced with second cylinders 154, 156 that have smaller cutoff lengths than first cylinders 54, 56 (e.g., blanket and plate cylinder sleeves have been removed and replaced with blanket and plate cylinder sleeves having smaller outer circumferences, as described below). To adjust support apparatus 10 to accommodate cylinders 154, 156, adjustable blocks 47, 47' are moved vertically by actuators 92, 92', in particular by smart motors 48, 48' rotating threaded rods 46, 46' to move adjustable blocks 47, 47' upward with respect to frame 12. Sliding elements 32, 32' have been moved upward in slots 32, 32' so that stops 44, 44' on sliding elements 32, 32' contact adjustable blocks 47, 47' at the tops of stop guide slots 45, 45'. The maximum vertical positions of sliding elements 32, 32' are fixed by adjustable blocks 47, 47' at a higher level in comparison to the maximum vertical positions of sliding elements 32, 32' in FIGS. 3*a* to 3*c*.

The position of adjustable blocks 47, 47' sets the printing position of blanket cylinder 156, which is used to set the printing position of impression cylinder 58. When a print job of a particular cutoff length is to be printed by printing unit 50, adjustable blocks 47, 47' are positioned based on diameters of a plate cylinder and a blanket cylinder for the print job. Because in the embodiment shown in FIGS. 1 to 4 plate cylinder supports 14, 14' are non-rotatably fixed to frame 12 and cannot be moved toward and away from blanket cylinder supports 16, 16', for a cutoff change that involves setting up printing unit 50 for a larger cutoff than a print job most recently printed by printing unit 50, adjustable blocks 47, 47' are moved downward parallel to frame 12 and blanket cylinder supports 16, 16' are moved away from plate cylinder supports 14, 14'.

For a cutoff change that involves setting up printing unit 50 for a smaller cutoff than a print job most recently printed by printing unit 50, adjustable blocks 47, 47' are moved upward parallel to frame 12 and blanket cylinder supports 16, 16' are moved toward plate cylinder supports 14, 14'. When actuators 24, 24' position sliding elements 32, 32' so stops 44, 44' contact adjustable blocks 47, 47' at the tops of stop guide slots 45, 45, the roller cam of arm 28 and slot 30 (FIG. 1) interact to restrict the movement of blanket cylinder support 16 by the contact between the roller cam of arm 28 and upper face 30*a* (FIG. 1) and lower face 30*b* (FIG. 1) of slot 30 (FIG. 1) and roller cam 100 of arm 28' and slot 30' (FIG. 21) interact to restrict the movement of blanket cylinder support 16' by the contact between the roller cam of arm 28' and upper face 30*a*' (FIG. 2) and lower face 30*b*' (FIG. 2) of slot 30' (FIG. 2).

Positions of adjustable blocks 47, 47' are selected for a cutoff so the roller cam of arm 28 and roller cam 100 of arm 28' are positioned to contact the respective lower faces 30*b*, 30*b*' when blanket cylinder supports 16, 16' are moved toward plate cylinder supports 14, 14' by impression cylinder supports 18, 18'. To ensure a desired printing arrangement, positions of adjustable blocks 47, 47' are set so a nip pressure between plate cylinder 154 and blanket cylinder 156 is optimum when the lower faces of slots in blanket cylinder supports 16, 16' are moved into contact with rollers of arms 28, 28' by impression cylinder supports 18, 18'. In a preferred embodiment, arms 28, 28' are not moved by the contact between rollers of arms 28, 28' and lower faces 30*b*, 30*b*'. In order to set the proper positioning of impression cylinder 58 with respect to blanket cylinder 156, the position of cam 38 (FIG. 1) may be adjusted by moving cam 38 about pivot 42 (FIG. 1) by actuator 40 (FIG. 1) and the position of cam 38' (FIG. 1) may be adjusted by moving cam 38' about a pivot on blanket cylinder support 16' by an actuator on blanket cylinder support 16'.

In other embodiments, plate cylinder supports 14, 14' may be rotatably fixed to frame 12 and the position of plate cylinder supports 14, 14' may be adjusted during cutoff changes.

In an alternative embodiment, variable cutoff printing unit 50 may be a perfecting printing unit that includes two plate cylinders and two blanket cylinders for printing on both sides of a web passing between the two blanket cylinders.

In a preferred embodiment, removable sleeves may be used in printing unit 50 to allow printing unit 50 accommodate printing plates and printing blankets of varying cutoff lengths. Plate cylinders supported by plate cylinder supports 14, 14' and blanket cylinders supported by blanket cylinder supports 16, 16' may each include a base cylinder or mandrel that is held at both axial end by the respective supports 14, 14' or 16, 16', a sleeve that is slid over the outer surface of the mandrel and a plate or blanket that is wrapped around or slid over the sleeve (i.e., sleeves are similar to the sleeves described in incorporated by reference U.S. Pat. No. 5,813,336). For example, during a cutoff change, at work side 10*b*, blanket cylinder support 16" is uncoupled from and swung away from the work side end of a blanket cylinder mandrel. A blanket cylinder sleeve mounted on the blanket cylinder mandrel is then slid off of the blanket cylinder mandrel. A blanket mounted on the blanket cylinder sleeve may be removed before or after the blanket cylinder sleeve is slid off of the blanket cylinder mandrel. A different blanket cylinder sleeve having a larger or small outer circumference may then be mounted on the blanket cylinder mandrel. A new blanket may be mounted on the different blanket cylinder sleeve before or after the different blanket cylinder sleeve is slid onto the blanket cylinder mandrel. Removal and replacement of plate cylinders during cutoff changes may occur in the same manner, but with printing plates being mounted on the sleeves instead of blankets. Also, the blanket and plate cylinder mandrels may include holes formed in the outer surfaces thereof so pressurized air may be supplied internally to the mandrels and flow out of the holes to pneumatically mount and remove the sleeves from the respective mandrels. The blanket and plate cylinder mandrels may also include beveled ends on the work side thereof to facilitate the sliding of the sleeves onto the respective mandrel. The holes in the mandrels and the beveled ends, and the elasticity of the sleeves, allow sleeves that have inner circumferences that are slightly smaller than the outer circumferences of the mandrels to be mounted on the mandrels. After a sleeve is slid onto a respective mandrel, the supply of air to the mandrel is stopped and the sleeve is snugly held in place on the mandrel.

Figure 5A:
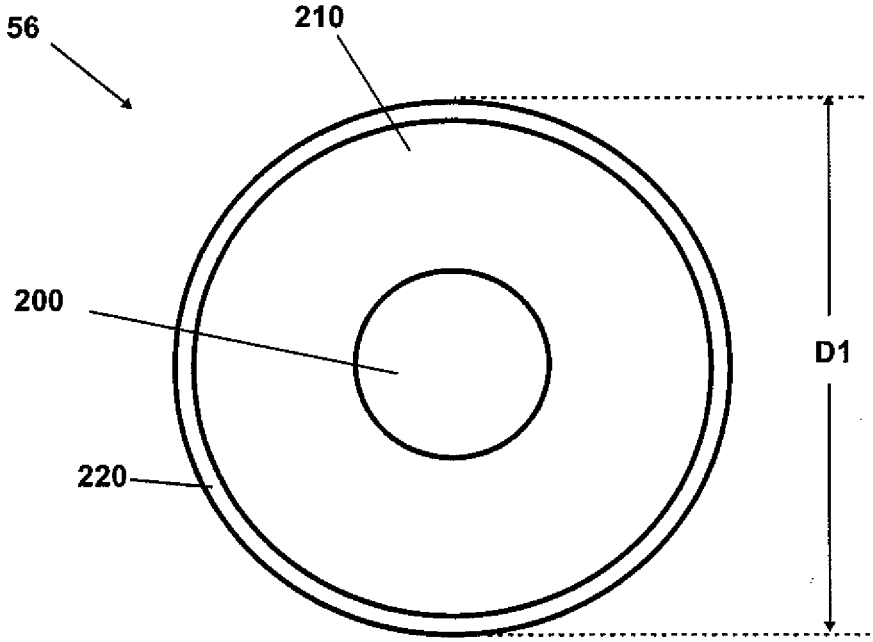
FIGS. 5*a* and 5*b* show axial views of blanket cylinders according to an embodiment of the present invention.
Figure 5B:
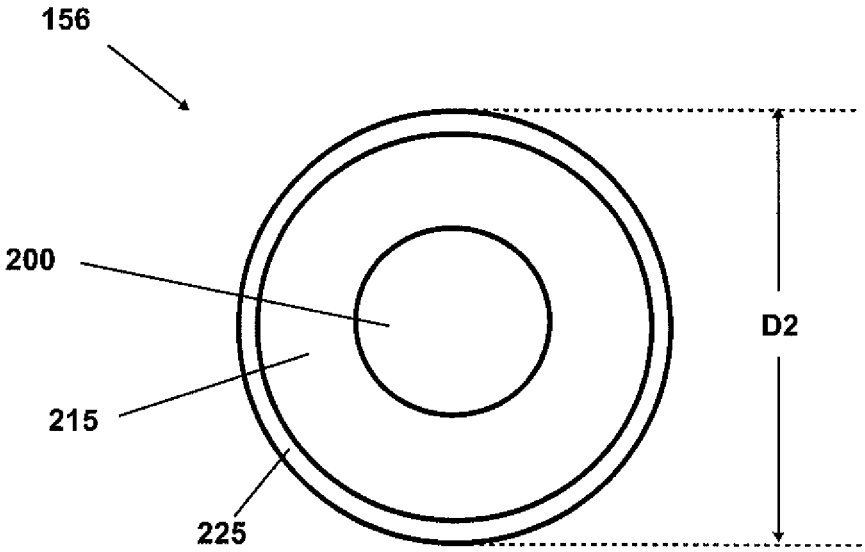

FIGS. 5*a* and 5*b* show axial views of blanket cylinders 56, 156 according to a preferred embodiment of the present invention. As shown in FIG. 5*a*, blanket cylinder 56 may include a mandrel 200, a sleeve 210 slid around the outer circumference of mandrel 200 and a printing blanket 220 mounted on sleeve 210. When printing blanket 220 is supported on blanket cylinder supports 16, 16 (FIGS. 1 to 4) by mandrel 200 and sleeve 210, printing blanket 220 has an effective diameter D1. As shown in FIG. 5*b*, blanket cylinder 156 may include mandrel 200, a sleeve 215 slid around the outer circumference of mandrel 200 and a printing blanket 225 mounted on sleeve 215. When printing blanket 220 is supported on blanket cylinder supports 16, 16 (FIGS. 1 to 4) by mandrel 200 and sleeve 210, printing blanket 225 has an effective diameter D2 that is smaller than effective diameter D1. As similarly described above, in a preferred embodiment, a cutoff change that involves changing from blanket cylinder 56 to blanket cylinder 156 may involve sliding sleeve 210 and printing blanket 220 off of mandrel 200 and sliding sleeve 215 and printing blanket 225 onto mandrel 200. Plate cylinders 54, 154 (FIGS. 3*a* to 4) may be configured in the same manner as blanket cylinder 56, 156, with plate cylinders 54, 154 including a mandrel, respective removable sleeves and respective removable printing plates mounted on the respective sleeves.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A variable cutoff printing unit comprising:

a plate cylinder;

a plate cylinder support removably supporting the plate cylinder;

a blanket cylinder;

a blanket cylinder support removably supporting the blanket cylinder, the blanket cylinder support including a bottom face and a top face that define a blanket cylinder support slot in the blanket cylinder support, the blanket cylinder support movable between an on printing position and an off printing position;

an arm;

a sliding element coupled to the arm and the arm coupled to the blanket cylinder support for moving the blanket cylinder support toward and away from the plate cylinder support, the arm extending into the blanket cylinder support slot such that, in the on printing position, the arm contacts the bottom face of the blanket support slot and does not contact the top face of the blanket cylinder support slot, and in the off printing position, the arm contacts the top face of the blanket support slot and does not contact the bottom face of the blanket cylinder support slot; and a stopping device for stopping movement of the sliding element to limit the movement of the blanket cylinder toward and away from the plate cylinder to a defined range.

2. The variable cutoff printing unit recited in claim 1 further comprising a blanket actuator for moving the sliding element to move the blanket cylinder support toward and away from the plate cylinder support.

3. The variable cutoff printing unit recited in claim 1 further comprising a frame, the plate cylinder support and the blanket cylinder support being coupled to the frame, the frame including a frame slot defined therein, the sliding element sliding within the frame slot.

4. The variable cutoff printing unit recited in claim 1 wherein the stopping device includes an adjustable block that sets a printing position of the blanket cylinder by stopping movement of the sliding element.

5. The variable cutoff printing unit recited in claim 4 wherein the stopping device includes an actuator for adjusting a position of the adjustable block.

6. The variable cutoff printing unit recited in claim 1 further comprising an impression cylinder, an impression cylinder support supporting the impression cylinder and an impression cylinder support actuator for moving the impression cylinder toward and away from the blanket cylinder.

7. The variable cutoff printing unit recited in claim 6 wherein the impression cylinder support actuator moves the blanket cylinder and the impression cylinder into the on printing position by forcing the impression cylinder support against the blanket cylinder support causing the arm to contact the bottom face of the blanket cylinder support slot.

8. The variable cutoff printing unit recited in claim 1 wherein at least one of the blanket cylinder support and the impression cylinder support includes a cam.

9. The variable cutoff printing unit recited in claim 8 wherein the at least one of the blanket cylinder support and the impression cylinder support including the cam includes a cam actuator for moving the blanket cylinder toward the plate cylinder.

10. The variable cutoff printing unit recited in claim 1 wherein the plate cylinder includes a mandrel supported by the plate cylinder support, the mandrel adapted for supporting a plurality of sleeves of different diameters, each of the plurality of sleeves adapted for supporting a respective printing plate having an effective diameter when on the respective sleeve.

11. The variable cutoff printing unit recited in claim 1 wherein the blanket cylinder includes a mandrel supported by the blanket cylinder support, the mandrel adapted for supporting a plurality of sleeves of different diameters, each of the plurality of sleeves adapted for supporting a respective printing blanket having an effective diameter when on the respective sleeve.

12. The variable cutoff printing unit recited in claim 11 wherein the position of the stopping device is adjustable based on the effective diameter of the printing blanket supported by the blanket cylinder support.

13. The variable cutoff printing unit recited in claim 1 further comprising:

a blanket actuator for moving the sliding element to move the blanket cylinder support toward and away from the plate cylinder support to support plate cylinders and blanket cylinders having different cut-offs;

an impression cylinder;

an impression cylinder support supporting the impression cylinder; and an impression cylinder support actuator movable between an extended position and a retracted position, the impression cylinder support actuator connected to the impression cylinder support, the impression cylinder support actuator moving the blanket cylinder and the impression cylinder into the on printing position in the extended position by forcing the impression cylinder support against the blanket cylinder support and causing the arm to contact the bottom face of the slot, the impression cylinder support actuator moving the blanket cylinder and the impression cylinder into the off printing position in the retracted position by lowering the impression cylinder support and the blanket cylinder support and causing the arm to contact the top face of the slot.

14. A variable cutoff printing unit comprising:

a frame;

a blanket cylinder;

an additional cylinder;

a blanket cylinder support supporting the blanket cylinder, the blanket cylinder support including a bottom face and a top face that define a slot in the blanket cylinder support, the blanket cylinder movably supported in the frame between an on printing position and an off printing position;

an additional cylinder support supporting the additional cylinder, the additional cylinder support movably supported in the frame for lifting the blanket cylinder support into the on printing position and dropping the blanket cylinder support into the off printing position; and an arm supported in the frame and extending into the slot such that in the on printing position the arm contacts the bottom face and does not contact the top face, and in the off printing position the arm contacts the top face and does not contact the bottom face.

15. The variable cutoff printing unit recited in claim 14 further comprising an additional cylinder support actuator for moving the blanket cylinder and the additional cylinder into the on printing position by forcing the additional cylinder support against the blanket cylinder support and causing the arm to contact the top face of the slot.

16. The variable cutoff printing unit recited in claim 14 wherein the additional cylinder is an impression cylinder.

17. The variable cutoff printing unit recited in claim 14 further comprising a stopping device for stopping movement of the arm to limit the movement of the blanket cylinder toward the additional cylinder to a range defined by a distance between the bottom face and the top face.

18. The variable cutoff printing unit recited in claim 17 further comprising a stop that is coupled to the arm, the stopping device including an adjustable block for stopping movement of the arm by stopping movement of the stop.

19. The variable cutoff printing unit recited in claim 18 wherein the stopping device includes an actuator for adjusting a position of the adjustable block.

20. The variable cutoff printing unit recited in claim 19 wherein the position of the stopping device is adjustable based on a diameter of the blanket cylinder.

21. The variable cutoff printing unit recited in claim 14 wherein the blanket cylinder includes a mandrel supported by the blanket cylinder support, the mandrel adapted for supporting a plurality of sleeves of different diameters, each of the plurality of sleeves adapted for supporting a respective printing blanket having an effective diameter when on the respective sleeve that defines a diameter of the blanket cylinder.

22. The variable cutoff printing unit recited in claim 21 wherein a spacing between the blanket cylinder support and the additional cylinder support is set based on the effective diameter of the printing blanket supported by the blanket cylinder support.

23. A method of operating a variable cutoff printing unit including a blanket cylinder support having a slot formed therein, an additional cylinder support, an arm extending into the slot, a sliding element coupled to the arm and a stopping device, the method comprising:

setting a position of the blanket cylinder support by contacting the stopping device with the sliding element as the arm contacts a top face of the slot formed in the blanket cylinder support in an off printing position of the blanket cylinder support, wherein the arm is not in contact with a bottom face of the slot; and moving the blanket cylinder support from the off printing position into an on printing position by contacting the blanket cylinder support with the additional cylinder support so that the arm moves out of contact with the top face of the slot and into contact with the bottom face of the slot.

24. The method recited in claim 23 wherein a first blanket is mounted on the blanket cylinder support, the first blanket having a first effective diameter when mounted on the blanket cylinder support.

25. The method recited in claim 24 further comprising:

removing the first blanket from the blanket cylinder support;

adjusting a position of the stopping device;

placing a second blanket on the blanket cylinder support, the second blanket having a second effective diameter when mounted on the blanket cylinder support, the second effective diameter being different from the first effective diameter;

setting a position of the blanket cylinder support based on the second effective diameter by contacting the stopping device with the sliding element so the arm contacts the top face of the slot formed in the blanket cylinder support; and moving the second blanket into an on printing position by contacting the bottom face of the slot with the arm.

26. The method recited in claim 25 wherein the second blanket is placed on the blanket cylinder support after the position of the stopping device is adjusted.

27. The method recited in claim 25 wherein the first blanket is supported on the blanket cylinder support by a mandrel supported by the blanket cylinder support and a first sleeve removably mounted on the mandrel, the removing the first blanket from the blanket cylinder support includes sliding the first sleeve off of the mandrel, and the placing the second blanket cylinder on the blanket cylinder support includes placing the second blanket on a second sleeve and sliding the second sleeve onto the mandrel.

* * * * *